US008397535B2

(12) United States Patent
Howard et al.

(10) Patent No.: US 8,397,535 B2
(45) Date of Patent: Mar. 19, 2013

(54) METHOD AND APPARATUS FOR PRESSURIZED PRODUCT PRODUCTION

(75) Inventors: Henry Edward Howard, Grand Island, NY (US); Richard John Jibb, Wheatfield, NY (US); David Ross Parsnick, Amherst, NY (US); Todd Alan Skare, Madrid (ES); Maulik Shelat, Williamsville, NY (US)

(73) Assignee: Praxair Technology, Inc., Danbury, CT (US)

( * ) Notice: Subject to any disclaimer, the term of this patent is extended or adjusted under 35 U.S.C. 154(b) by 946 days.

(21) Appl. No.: 12/485,235

(22) Filed: Jun. 16, 2009

(65) Prior Publication Data

US 2010/0313600 A1 Dec. 16, 2010

(51) Int. Cl.
*F25J 3/02* (2006.01)

(52) U.S. Cl. ..... 62/652

(58) Field of Classification Search ..... 62/643, 62/652, 903

See application file for complete search history.

(56) References Cited

U.S. PATENT DOCUMENTS

| | | | | |
|---|---|---|---|---|
| 5,758,515 | A | 6/1998 | Howard | |
| 5,806,341 | A | 9/1998 | Rathbone | |
| 6,257,020 | B1 | 7/2001 | Tranier | |
| 6,718,795 | B2 | 4/2004 | Briglia | |
| 2007/0289726 | A1 * | 12/2007 | Jibb et al. | 165/165 |
| 2007/0295027 | A1 * | 12/2007 | Howard et al. | 62/640 |
| 2008/0134718 | A1 * | 6/2008 | Howard et al. | 62/643 |

* cited by examiner

*Primary Examiner* — Frantz Jules
*Assistant Examiner* — Webeshet Mengesha
(74) *Attorney, Agent, or Firm* — David M. Rosenblum

(57) ABSTRACT

The present invention relates to a method and apparatus for producing a pressurized product stream product by cryogenic rectification. A main heat exchanger, used in the cryogenic rectification, warms a pumped product stream composed of oxygen-rich or nitrogen-rich liquid and thereby produces the pressurized product stream. Layers of the main heat exchanger are designed such that a reduction in the heat transfer area provided within the main heat exchanger for warming the pumped product stream occurs at a location at which the temperature of the pumped product stream exceeds either the critical or a dew point temperature of such stream. The reduction in heat transfer area leaves regions of the layers able to heat or cool another stream that is used in connection with the cryogenic rectification. Such other stream can be a refrigerant stream that allows the introduction of additional refrigeration to increase production of liquid products.

14 Claims, 4 Drawing Sheets

METHOD AND APPARATUS FOR PRESSURIZED PRODUCT PRODUCTION

FIELD OF THE INVENTION

The present invention relates to a method and apparatus for producing a pressurized product stream by cryogenic rectification in which the product stream is formed from a pumped product stream composed of oxygen-rich or nitrogen-rich liquid that is warmed within a main heat exchanger that is used in connection with the cryogenic rectification. Even more particularly, the present invention relates to such a method and apparatus in which the pumped product is warmed within layers of the main heat exchanger that are designed to both warm the pumped liquid product and warm or cool another stream.

BACKGROUND OF THE INVENTION

Oxygen is separated from oxygen containing feeds, such as air, through cryogenic rectification. In cryogenic rectification, the feed is compressed, if not obtained in a pressurized state, purified of contaminants and then cooled in a main heat exchanger to a temperature suitable for its rectification. The cooled feed is then introduced into a distillation column system having high and low pressure columns in which nitrogen is separated from the oxygen to produce oxygen and nitrogen-rich product streams that warm within the main heat exchanger to help cool the incoming feed. As well known in the art, an argon column can also be provided that receives an argon-rich stream from the low pressure column and separates the argon from the oxygen to produce an argon containing product.

The oxygen that is separated from the feed can be taken as a liquid product that can be produced in the low pressure column as an oxygen-rich liquid column bottoms. Liquid product can additionally be taken from part of the nitrogen-rich liquid used in refluxing the columns. As known in the art, the oxygen liquid product can be pumped and then in part taken as a pressurized liquid product and also, heated in the main heat exchanger to produce an oxygen product as a vapor or as a supercritical fluid depending on the degree to which the oxygen is pressurized by the pumping. The liquid nitrogen can similarly be pumped and taken as either a pressurized liquid product, a high pressure vapor or a supercritical fluid. In order to heat the oxygen containing stream in the main heat exchanger, part of the feed can be further compressed, cooled and expanded into a liquid. The liquid can be introduced into either or both of the high and the low pressure columns.

In order to operate a cryogenic rectification plant, refrigeration must be supplied to offset ambient heat leakage, warm end heat exchange losses and to allow the production of liquid products. Refrigeration is typically supplied by expanding part of the air or a waste stream from the low pressure column within a turboexpander to generate a cold exhaust stream. The cold exhaust stream is then introduced into the distillation column or the main heat exchanger. External refrigeration can also be imparted by refrigerant streams introduced into the main heat exchanger. Refrigeration can also be generated through closed loop, external refrigeration cycles.

The main heat exchanger is typically formed by brazed aluminum, plate fin construction. In such a heat exchanger, layers containing fins, defined between parting sheets, form the passages for indirectly exchanging heat between the incoming streams and the return streams produced in the distillation columns. For example, layers are provided for indirectly exchanging heat between an oxygen-rich liquid stream that has been pumped and part of the feed stream that has been raised in pressure by a booster compressor. The main heat exchanger can be formed from several of such units and can be further separated into high pressure heat exchangers for heating the pumped oxygen-rich stream and low pressure heat exchangers for cooling the remainder of the incoming feed. In any event, the cost of such heat exchangers represents a major cost of the cryogenic rectification plant and typically, the price of a particular heat exchanger is based upon its volume.

Where air is expanded for providing the refrigeration, part of the air, after having been compressed and purified is further compressed in a booster compressor, partially cooled within the main heat exchanger and then is expanded in a turboexpander coupled to the booster compressor. This arrangement is known in the art as a turbine loaded booster compressor. In any case, since the air is partially warmed to a temperature between the warm and cold end temperatures of the main heat exchanger, portions of layers remain open for use in other heat exchange duties. In a pumped liquid oxygen plant, these portions can be used in cooling part of the air or feed stream that is provided for warming the pumped liquid oxygen. This of course reduces the size and cost of the main heat exchanger that would otherwise exist if these portions of the layers were left unused.

As will be discussed, the present invention provides a method of producing an oxygen product by cryogenic rectification or an apparatus for conducting such cryogenic rectification with the object of producing high pressure oxygen in which the main heat exchanger is able to be fabricated in either a more compact manner than that contemplated in the prior art or alternatively, for a given size of heat exchanger, higher volumetric flows are able to be brought into an indirect heat exchange relationship. Moreover, such a heat exchanger can be integrated to accept an external refrigerant stream to increase production of liquid products if the same are produced by the plant.

SUMMARY OF THE INVENTION

The present invention, in one aspect, provides a method of producing a pressurized product stream. In accordance with such method, a feed stream containing oxygen and nitrogen is rectified by a cryogenic rectification process utilizing a main heat exchanger of plate-fin construction and a distillation column system operatively associated with the main heat exchanger. A product stream withdrawn from the distillation column system and composed of oxygen-rich liquid or nitrogen-rich liquid is pumped to produce a pumped product stream. At least part of the pumped product stream is warmed within layers of the main heat exchanger to produce the pressurized product stream and one other stream is warmed or cooled within such layers. The layers providing a heat transfer area within the main heat exchanger for the warming of the at least part of the pumped product stream that decreases, at least in part, by provision of regions within layers for warming or cooling of the one other stream. The regions are positioned within the layers such that the heat transfer area decreases at a location of the main heat exchanger at which a temperature is reached within the main heat exchanger that exceeds the critical or dew point temperature of the pumped product stream.

It is to be noted although the claims are addressed to a method of producing a pressurized product stream, it is not intended that the present invention be limited to a cryogenic rectification process or plant employing such process in which only a single pressurized product stream is produced in that the method could be applied to produce a nitrogen-rich product stream or an oxygen-rich product stream or both simultaneously. Further, the term, "main heat exchanger" as used herein and in the claims includes one of such units or several of such units connected in parallel. A principle under which the present invention operates is that it takes more heat to warm the pumped liquid oxygen stream to its critical temperature, if a supercritical fluid is the intended or to the dew point temperature if a vapor product is desired then to afterwards warm either of such streams to the warm end temperature of the main heat exchanger. In the prior art, however, the layers within the main heat exchanger that are used for warming the pumped liquid oxygen stream are designed to warm subsidiary streams thereof from entering the cold end temperature of the pumped liquid oxygen stream to the warm end temperature of the main heat exchanger. Consequently, not all of the heat transfer area provided by the layers in such a prior art heat exchanger are being efficiently used because there is less heat transfer duty in warming the subsidiary streams from the critical temperature or dew point temperature to ambient. In the present invention, however, once the critical temperature or dew point temperature is exceeded, the subsidiary streams are combined leaving regions within the layers available for heating or cooling another stream. In such manner, the main heat exchanger can be fabricated in a more compact manner than in the prior art, resulting in substantial savings in the acquisition costs of such heat exchanger. Moreover, as will be discussed, there are other advantageous operations that are made available by such arrangement in connection with the production of liquid products.

The layers of the main heat exchanger can include a first set of layers and a second set of layers, each of the first set of layers and the second set of layers having first sections and second sections. Subsidiary streams composed of the at least part of the pumped product stream are introduced into the first sections of the first set of layers and the second set of layers. The subsidiary streams, after having been warmed within the first sections, are combined and introduced into the second sections of the first set of layers as combined subsidiary streams. The combined subsidiary streams are further warmed within the second sections of the first set of layers and the pressurized product stream is made up of the combined subsidiary streams after having been further warmed in the second sections of the first set of layers. The regions for warming or cooling the one other stream associated with the cryogenic distillation process are formed by the second sections of the second set of layers.

At least one liquid product can be produced by the distillation column system and the one other stream is a refrigerant stream that is warmed within the main heat exchanger to increase production of the at least one liquid product. In such embodiment, subsidiary refrigerant streams composed of the refrigerant stream are introduced into and warmed within the second sections of the second set of layers. The refrigeration stream can be produced in a closed loop refrigeration cycle. Such a cycle can include compressing the refrigerant stream after having been warmed in the main heat exchanger, further compressing the refrigerant stream and subsequently expanding the refrigerant stream in a turbine to form an exhaust stream that is introduced into the second section of the second set of the layers.

The product stream withdrawn from the distillation column can be composed of the oxygen-rich liquid. The cryogenic rectification process can include compressing and purifying the feed stream to produce a compressed and purified feed stream. The compressed and purified feed stream is divided into a first compressed stream and a second compressed stream. The first compressed stream is further compressed and then fully cooled in the main heat exchanger to form a liquid stream. In this regard, the term "fully cooled" as used herein and in the claims means cooled to a cold end temperature of the main heat exchanger. The liquid stream can be expanded and introduced into at least one of a high pressure column and a low pressure column. The low pressure column is operatively associated with the high pressure column such that nitrogen-rich vapor produced as high pressure column overhead in the high pressure column is condensed to form reflux for the high pressure column and the low pressure column against vaporizing an oxygen-rich liquid column bottoms of the low pressure column. This forms the oxygen-rich liquid from residual liquid within the low pressure column and an oxygen-rich high pressure column bottoms liquid in the high pressure column that is further refined in the low pressure column. The second compressed stream is further compressed, partially cooled within the main heat exchanger and expanded in a turboexpander to form an exhaust stream. In this regard, the term, "partially cooled" means cooled to a temperature that is between the warm and cold end temperatures of the main heat exchanger. The exhaust stream is introduced into the high pressure column. A low pressure nitrogen-rich vapor column overhead stream and an impure nitrogen waste stream extracted from the low pressure column are passed into the main heat exchanger to help cool the feed stream after the compression and purification thereof to the temperature suitable for its rectification. The at least one liquid product is formed from at least one of a remaining part of the pumped liquid oxygen stream or a nitrogen-rich liquid stream that is formed from a portion of the nitrogen-rich vapor that is condensed and not used as the reflux.

In another aspect, the present invention provides an apparatus for producing a pressurized product stream. In accordance with this aspect of the present invention, a cryogenic rectification plant is provided that is configured to separate oxygen from a feed stream containing oxygen and nitrogen. The cryogenic rectification plant has a main heat exchanger of plate-fin construction, a distillation column system operatively associated with the main heat exchanger and a pump. The pump is in flow communication with the distillation column system such that an oxygen-rich liquid or a nitrogen-rich liquid formed within the distillation column system is pumped to produce a pumped product stream. The main heat exchanger is connected to the pump and configured such that at least part of the pumped product stream is warmed within layers of the main heat exchanger to produce the pressurized product stream and one other stream is warmed or cooled within said layers. The layers are configured such that a heat transfer area provided within the main heat exchanger for the warming of the at least part of the pumped product stream decreases, at least in part, by provision of regions within at least part of the layers for warming or cooling of the one other stream. The regions are positioned within the layers, such that the heat transfer area decreases at a location within the main heat exchanger at which a temperature is reached that exceeds critical temperature or dew point temperature of the pumped product stream.

The layers can comprise a first set of layers and a second set of layers, each having first sections and second sections. Such layers are configured such that subsidiary streams, made up of the at least part of the pumped product, warm within the first sections and combine at connections between the first sections and form combined subsidiary streams. The second sections of the first set of layers are in flow communication with the first sections such that the combined subsidiary streams further warm within the second sections and form the pressurized product stream. The regions are the second sections of the second set of layers.

The cryogenic rectification plant can be configured to produce at least one liquid product and the one other stream is a refrigeration stream that warms within the main heat exchanger to increase production of the at least one liquid product. In such embodiment, subsidiary refrigeration streams composed of the refrigeration stream warm within the second sections of the second set of layers.

The cryogenic rectification plant can also be provided with a refrigeration system connected to the heat exchanger and configured to produce the refrigeration stream and to circulate the refrigerant stream through the second sections of the first set of layers. The refrigeration system can incorporate a closed loop refrigeration cycle. Further, the cryogenic rectification plant can include a main compressor to compress the feed stream and the refrigeration system can contain a valve operable to be set in an open position and situated to receive part of the feed stream after compression. In such embodiment, the refrigeration stream is formed from the part of the feed stream that thereby serves as make-up for the refrigeration stream. The refrigeration system can have a recirculation compressor connected to the main heat exchanger and in flow communication with the second sections of the first set of the layers such that the refrigerant stream after having been warmed in the main heat exchanger is compressed in the recirculation compressor, a booster compressor further compresses the refrigerant stream and a turbine connected between the booster compressor and the location of the main heat exchanger such that an exhaust stream flows from the booster compressor into the second sections of the first set of the layers.

The product stream withdrawn from the distillation column system can be composed of the oxygen-rich liquid. The cryogenic rectification plant can comprise the distillation column system including a low pressure column operatively associated with a high pressure column such that nitrogen-rich vapor produced as high pressure column overhead is condensed to form reflux for the high pressure column and the low pressure column against vaporizing an oxygen-rich liquid column bottoms of the low pressure column. In such case, the oxygen-rich liquid is formed from residual liquid within the low pressure column and oxygen-rich high pressure column bottoms liquid is further refined in the low pressure column.

A main compressor is connected to a purification unit for compressing and purifying the feed stream to produce a compressed and purified feed stream. A booster compressor is in flow communication with the purification unit to further compress a first compressed stream formed from another part of the compressed and purified feed stream. The main heat exchanger is in flow communication with the booster compressor and also configured to form a liquid stream. An expansion device is connected to the main heat exchanger to expand the liquid stream. At least one of the high pressure column and the low pressure column is in flow communication with the expansion device to receive the liquid stream. Another booster loaded turbine unit is connected to the main heat exchanger, in flow communication with the purification unit, so that a second compressed stream formed from a yet further part of the compressed and purified feed stream is further compressed, partially cooled within the main heat exchanger and expanded in a turboexpander to form an exhaust stream. The turboexpander is in flow communication with the high pressure column such that the exhaust stream is introduced into the high pressure column. The main heat exchanger is also in flow communication with the low pressure column and configured so that a low pressure column overhead stream and an impure nitrogen waste stream passes from the low pressure column into the main heat exchanger and flow between the cold end and the warm end thereof to help cool the feed stream after compression to the temperature suitable for its rectification. At least one outlet is provided for discharging the at least one liquid product from at least one of another part of the pumped liquid oxygen stream and a portion of a nitrogen-rich liquid stream produced in the distillation column system.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawings in which:

DETAILED DESCRIPTION

Figure 1:
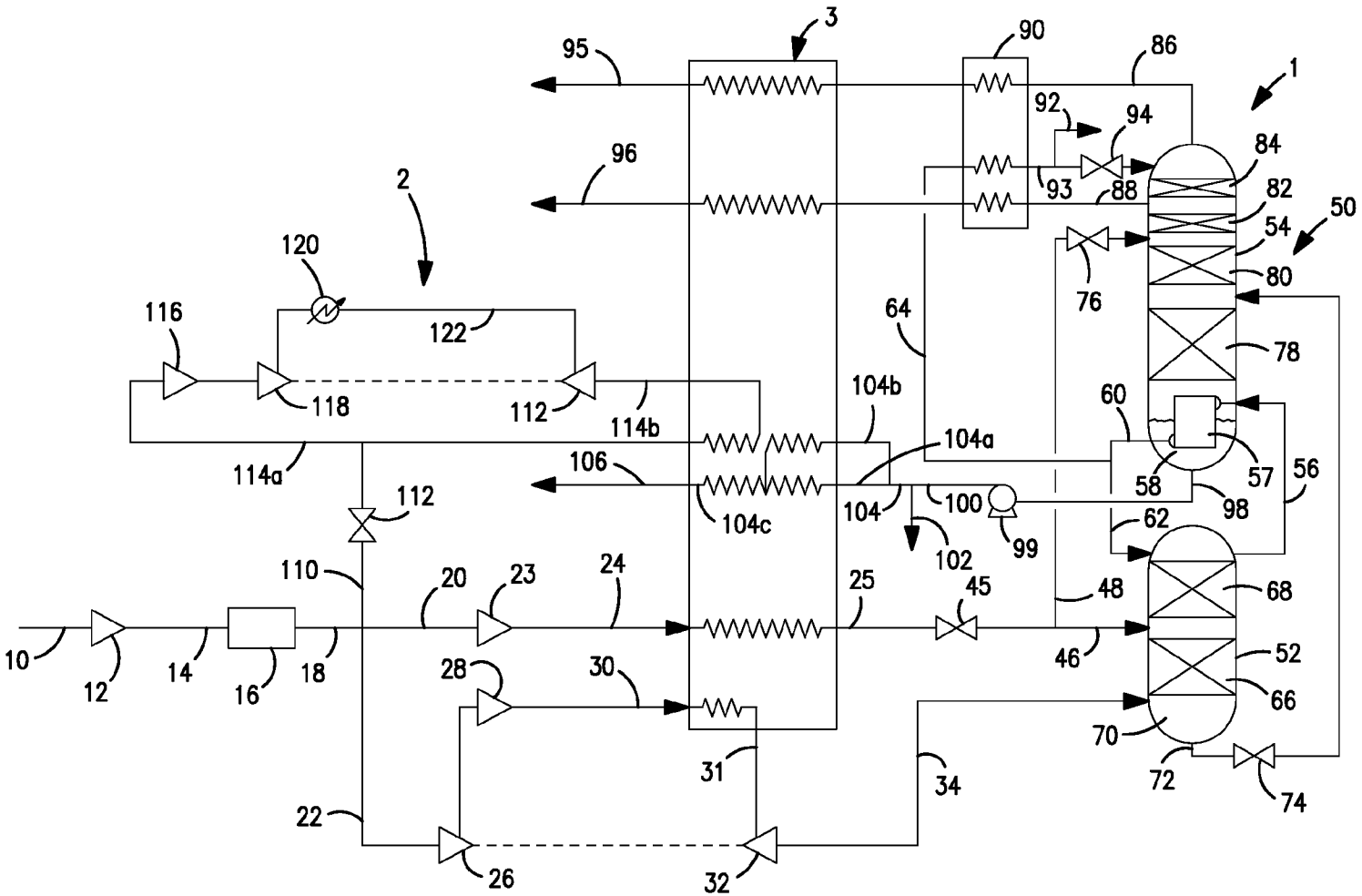
FIG. 1 is a schematic process flow diagram of a cryogenic rectification plant for carrying out a method of the present invention in which a closed loop refrigeration cycle is employed to increase liquid production.

With reference to FIG. 1, a cryogenic air separation plant 1 is illustrated that is integrated with a closed loop refrigeration system 2, discussed hereinafter, to increase production of liquid products. This integration is accomplished with the use of a heat exchanger 3 that is provided with layers that allow subsidiary streams of pumped liquid oxygen to reach a temperature that exceeds either at the dew point or the critical temperature of the pumped liquid oxygen and then combine such subsidiary streams to leave regions of layers free for warming a refrigerant stream produced in the closed loop refrigeration cycle. It is understood, however, that the integration of air separation plant 1 and closed loop refrigeration system 2 is but one application of the present invention.

As to air separation plant 1, an air stream 10 is introduced into a cryogenic air separation plant 1 to separate oxygen from the nitrogen. Air stream 10 is compressed within a first compressor 12 to a pressure that can be between about 5 bar(a) and about 15 bar(a). Compressor 12 may be an intercooled, integral gear compressor with condensate removal that is not shown. It is to be noted that in certain integrations, the air stream 10 could be obtained at pressure or could be bleed air from a compressor or some other source of an oxygen and nitrogen containing stream.

After compression, the resultant compressed feed stream 14 is introduced into a prepurification unit 16. Prepurification unit 16, as well known in the art, typically contains beds of alumina and/or molecular sieve operating in accordance with a temperature and/or pressure swing adsorption cycle in which moisture and other higher boiling impurities are adsorbed. Also, as known in the art, such higher boiling impurities are typically, carbon dioxide, water vapor and hydrocarbons. While one bed is operating, another bed is regenerated. Other processes could be used such as direct contact water cooling, refrigeration based chilling, direct contact with chilled water and phase separation.

The resultant compressed and purified feed stream 18 is then divided into a stream 20 and a stream 22. Typically, stream 20 is between about 25 percent and about 35 percent by volume of the compressed and purified feed stream 18 and as illustrated, the remainder is stream 22.

Stream 20 is then further compressed within a compressor 23 which again may comprise an intercooled, integral gear compressor. The second compressor 23 compresses the stream 20 to a pressure between about 25 bar(a) and about 70 bar(a) to produce a first compressed stream 24. The first compressed stream 24 is thereafter introduced into main heat exchanger 3 where it is cooled and liquefied at the cold end of main heat exchanger 3 to produce a liquid stream 25.

Stream 22 is further compressed by a turbine loaded booster compressor 26 and yet further compressed by a second booster compressor 28 to a pressure that can be in the range from between about 20 bar(a) to about 60 bar(a) to produce a second compressed stream 30. Second compressed stream 30 is then introduced into main heat exchanger 3 in which it is partially cooled to a temperature in a range of between about 160 and about 220 Kelvin to form a partially cooled stream 31 that is subsequently introduced into a turboexpander 32 to produce an exhaust stream 34 that is introduced into the air separation unit 50. As can be appreciated, the compression of stream 22 could take place in a single compression machine. As illustrated, turboexpander 32 is linked with first booster compressor 26, either directly or by appropriate gearing. However, it is also possible that the turboexpander be connected to a generator to generate electricity that could be used on-site or routed to the grid.

Liquid stream 25, resulting from the cooling of the first compressed stream 24 within main heat exchanger 3, is partially expanded in an expansion valve 45 and divided into liquid streams 46 and 48 for eventual introduction into the air separation unit 50. Expansion valve 45 could be replaced by a liquid expander to generate part of the refrigeration.

The aforementioned components of the feed stream 10, oxygen and nitrogen, are separated within an air separation unit 50 that consists of a higher pressure column 52 and a lower pressure column 54. It is understood that if argon were a necessary product, an argon column could be incorporated into the distillation column unit 50. The lower pressure column 54 typically operates at between about 1.1 to about 1.5 bar(a).

The higher pressure column 52 and the lower pressure column 54 are linked in a heat transfer relationship such that a nitrogen-rich vapor column overhead, extracted from the top of higher pressure column 52 as a stream 56, is condensed within a condenser-reboiler 57 located in the base of lower pressure column 54 against boiling an oxygen-rich liquid column bottoms 58. The boiling of oxygen-rich liquid column bottoms 58 initiates the formation of an ascending vapor phase within lower pressure column 54. The condensation produces a liquid nitrogen containing stream 60 that is divided into streams 62 and 64 that reflux the higher pressure column 52 and the lower pressure column 54, respectively to initiate the formation of descending liquid phases in such columns.

Exhaust stream 34 is introduced into the higher pressure column 52 along with the liquid stream 46 for rectification by contacting an ascending vapor phase of such mixture within mass transfer contacting elements 66 and 68 with a descending liquid phase that is initiated by reflux stream 62. This produces a crude liquid oxygen column bottoms 70, also known as kettle liquid and the nitrogen-rich column overhead that has been previously discussed. A stream 72 of the crude liquid oxygen column bottoms 70 is expanded in an expansion valve 74 to the pressure of the lower pressure column 54 and is introduced into such column for further refinement. Second liquid stream 48 is passed through an expansion valve 76, expanded to the pressure of lower pressure column 54 and then introduced into lower pressure column 54.

Lower pressure column 54 is provided with mass transfer contacting elements 78, 80, 82 and 84 that can be trays or structured packing or random packing or other known elements in the art. As stated previously, the separation produces an oxygen-rich liquid column bottoms 58 and a nitrogen-rich vapor column overhead that is extracted as a nitrogen product stream 86. Additionally, a waste stream 88 is also extracted to control the purity of nitrogen product stream 86. Both nitrogen product stream 86 and waste stream 88 are passed through a subcooling unit 90. Subcooling unit 90 subcools reflux stream 64. Part of reflux stream 64 as a stream 92 may optionally be taken as a liquid product and a remaining part 93 may be introduced into lower pressure column 54 after having been reduced in pressure across an expansion valve 94.

After passage through subcooling unit 90, nitrogen product stream 86 and waste stream 88 are fully warmed within main heat exchanger 3 to produce a warmed nitrogen product stream 95 and a warmed waste stream 96. Warmed waste stream 96 may be used to regenerate the adsorbents within prepurification unit 16. In addition, an oxygen-rich liquid stream 98 is extracted from the bottom of the lower pressure column 54 that consists of the oxygen-rich liquid column bottoms 58. Oxygen-rich liquid stream 98 can be pumped by a pump 99 to form a pumped product stream as illustrated by pumped liquid oxygen stream 100. Part of the pumped liquid oxygen stream 100 can optionally be taken as a liquid oxygen product stream 102. The remainder 104 can be fully warmed in main heat exchanger 3 and vaporized to produce a pressurized product stream in the form of oxygen product stream 106 at pressure and in a manner that will be discussed hereinafter.

It is to be noted that although first air separation plant 1 is illustrated as having higher and lower pressure columns connected in a heat transfer relationship by provision of condenser-reboiler 57, other types of plants are possible. For example, low purity oxygen plants can be used in connection with the present invention. In such plants, the higher and lower pressure columns are not connected in a latent heat transfer relationship as shown in FIG. 1. Rather, lowermost reboil of the lower pressure column is typically provided by the condensation or partial condensation of a compressed air stream that is afterwards fed into the higher pressure column.

As indicated in the above discussion, air separation plant 1 is capable of producing liquid products, namely, nitrogen-rich liquid by way of stream 92 and liquid oxygen product stream 102. In order to increase the production of such products, additional refrigeration is supplied by a refrigeration system that is illustrated as a closed loop refrigeration system 2 that uses air as the refrigerant. In this regard, part of the compressed and purified feed stream 18 as a stream 110 is used to charge the closed loop refrigeration system 2 by opening valve 112. After having been charged, valve 112 is returned to a closed position. A recycle stream 114*a*, at a pressure of between about 4 bara and about 11 bara and after having been warmed in main heat exchanger 3, is compressed in a recycle compressor 116 and then fed to a booster compressor 118 and a turboexpander 112 that is preferably as illustrated coupled to the booster compressor 118. After removal of the heat of compression within an after cooler 120, the resulting compressed refrigerant stream 122 is fed to the turboexpander 112 at a pressure of between about 35 and 75 bara to produce an exhaust stream composed of a cool refrigerant stream 114*b* that is fed into the main heat exchanger 3 at a pressure slightly above recycle stream 114*a*.

As can be appreciated, the degree to which refrigeration is supplied to main heat exchanger 3 can be generally controlled by controlling the power input to compressor 116. More specifically, inlet guidevanes may be employed with compressor 116 and 118 in order to maintain compression efficiency across a wide range of operation. Alternatively, the closed loop refrigeration system 2 can be turned on when more liquid product is desired and turned off when such increased production is not required. Although not shown in FIG. 1, in instances where increased fractions of gaseous oxygen are required (reduced liquid oxygen product), additional valves and conduits can be provided to allow the regions of layers used within main heat exchanger 3 that are used in warming the cool refrigerant stream 114*b* to alternatively be put to use in warming gaseous oxygen or by cooling second compressed stream 22 after having been compressed in compressor 28.

It is to be noted that in lieu of the closed loop refrigerant cycle 3, other refrigerant streams could be introduced into main heat exchanger 3, such as liquid cryogen streams, for example, liquid nitrogen, obtained from storage facilities in an enclave. Another possibility is to use all or part of nitrogen product stream 95 as the refrigerant. If the nitrogen product were desired at pressure, a nitrogen compressor could be used in lieu of the recycle compressor 116 and the refrigeration cycle would not be a closed cycle. A yet further possibility is to integrate the recycle compressor 116 and the booster compressor 118 with booster compressor 28 and booster compressor 23. Additionally, refrigeration cycles able to produce a low temperature refrigerant such as known mixed gas refrigeration cycles are possible that use refrigerants compatible with oxygen. Where nitrogen is used as the working fluid, a commercial lower temperature refrigerant like ammonia or R134a could be used in place of after cooler 120 that in case of air would use water. In addition, compressed refrigerant stream 112 may be further cooled within main heat exchanger 3 prior to expansion in turboexpander 112. This further precooling may be in addition to or in lieu of after cooler 120. Alternatively, after cooler 120 could be incorporated into main heat exchanger 3.

As is apparent from the Figure, the remainder 104 of the pumped liquid oxygen stream 100 is divided into first and second subsidiary streams 104*a* and 104*b*. Although only two such first and second subsidiary streams 104*a* and 104*b* are shown, there would be a series of such streams that are fed into layers of main heat exchanger 3. Pumped liquid oxygen stream 100 can be pressurized to above or below the critical pressure so that oxygen product stream 106 when discharged from heat exchanger 3 will be a supercritical fluid. Alternatively, the pressurization of pumped liquid oxygen stream could be lower to produce oxygen product stream 106 in a vapor form. In case of a supercritical fluid, a point would be reached at which the remainder 104 of the pumped liquid oxygen stream 100 would attain a critical temperature. In case of a vapor, a point would be reached within heat exchanger 3 in which the remainder 104 would reach its dew point. As can be appreciated by those skilled in the art, the heat that must be added in raising the temperature of remainder 104 of pumped liquid oxygen stream 100 to either a critical temperature or a dew point temperature is greater than that required in further warming such stream to a temperature at or about ambient temperature at the warm end of main heat exchanger 3. Consequently, when the first and second subsidiary streams 104*a* and 104*b* are either in excess of the critical temperature in case of supercritical pressurization or dew point temperature, in case of a pressurization that does not amount to a critical pressure, such streams can be warmed from such temperatures to warm end temperature of the main heat exchanger 3 in a heat transfer area that is less than that required to obtain such temperatures in the first instance. Since, the total heat transfer area that is provided by the layers, that are dedicated to warming the pumped liquid oxygen, can be reduced, regions of the layers can be freed for other purposes, namely to warm the cool refrigerant stream 114*b* within remaining regions of such layers. As a result, of the cool refrigerant stream 114*b* warming within the layers, additional refrigeration is imparted to air separation plant 1 to increase production of the liquid products. At the same time, however, the main heat exchanger is not enlarged with more layers to accommodate cool refrigerant stream 114*b*, the costs that would otherwise be incurred in fabricating a main heat exchanger that was enlarged with the additional layers is reduced.

Figure 2:
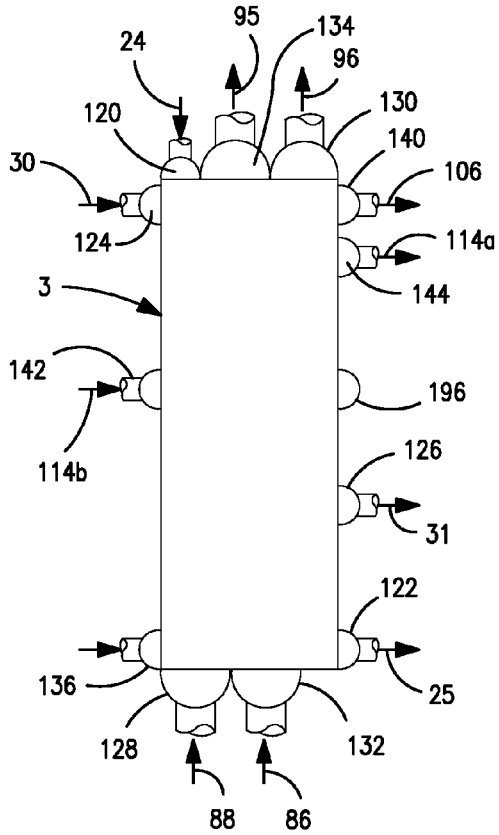
FIG. 2 is a side, elevational view of a heat exchanger used in the cryogenic rectification plant illustrated in FIG. 1.

With reference to FIG. 2, the heat exchanger 3 is of brazed aluminum plate-fin type construction. Such heat exchangers are advantageous due to their compact design, high heat transfer rates and their ability to process multiple streams. They are manufactured as fully brazed and welded pressure vessels. The brazing operation involves stacking corrugated fins, parting sheets and end bars to form a core matrix. The matrix is placed in a vacuum brazing oven where it is heated and held at brazing temperature in a clean vacuum environment. For small plants, a heat exchanger comprising a single core may be sufficient. For higher flows, a heat exchanger may be constructed from several cores which must be connected in parallel or series.

Main heat exchanger 3 is divided up into layers in a manner known in the art to conduct indirect heat exchange between streams flowing in adjacent layers. The streams to be heated or cooled are introduced into and extracted from the layers of the main heat exchanger 3 by way of a series of header tanks 120, 122, 124, 126, 128, 130, 132, 134, 136, 140, 142 and 144. All of the aforementioned header tanks are of semi-cylindrical configuration. Although such header tanks 120 through 144 extend the full depth of main heat exchanger 3, only the layers to receive and discharge a particular stream are in flow communication with the header tanks associated with such stream through inlet and outlet ports. All other layers are sealed from the flow using side bars. The layers are stacked in a ratio and in an order or pattern such that they provide safe and efficient heat transfer between hot streams and cold streams.

As illustrated, first compressed stream 24 enters header tank 120 from where such stream is further distributed into a set of layers located within main heat exchanger 3 where the stream liquefies to produce liquid streams that are collected within header tank 122 such that liquid stream 25 is able to be discharged therefrom. Similarly, second compressed stream 30 is introduced into header tank 124 and after passage through layers extending only part of the height of main heat exchanger 3, the streams are collected and discharged from header tank 126 as partially cooled stream 31 that is introduced into turboexpander 32. Nitrogen product stream 86 and waste stream 88 are introduced into headers 132 and 128, distributed into layers located within main heat exchanger 3 and associated with such streams and discharged as product nitrogen stream 95 and warm waste stream 96 from header tanks 134 and 130, respectively, located at the top of main heat exchanger 3.

Figure 3:
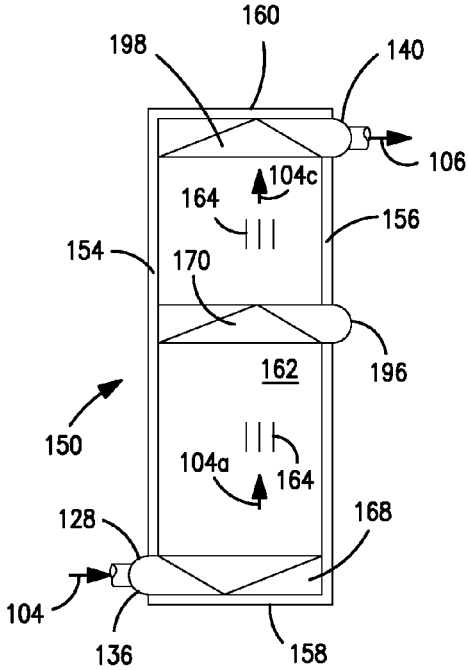
FIG. 3 is a sectional view of FIG. 2 illustrating one type of layer incorporated into the heat exchanger shown in FIG. 2.
Figure 4:
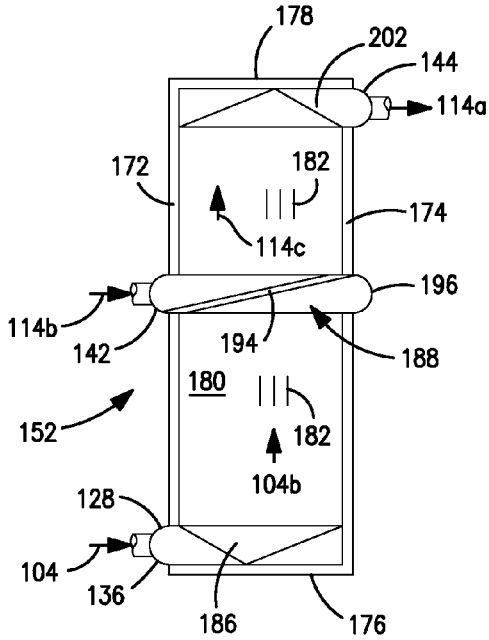
FIG. 4 is a sectional view of FIG. 2 illustrating another type of layer incorporated into the heat exchanger shown in FIG. 2 and also, is operatively associated with the layer shown in FIG. 3.

With additional reference to FIGS. 3 and 4, layers 150 and 152 are illustrated, respectively. These layers form layers within the main heat exchanger 3 that are associated with warming the remaining portion 104 of pumped liquid oxygen stream 100 and warming cool refrigerant stream 114*b* to produce recycle stream 114*a*. Both of such layers, at their bottom portions, are in flow communication with header tank 128 that receives the remaining portion 104 of the pumped liquid oxygen stream 100. Header tank 128 distributes such stream to layers 150 and 152 as subsidiary streams 104*a* and 104*b*. As could be appreciated, there would be multiple layers 150 and 152 in main heat exchanger 3 and as such, subsidiary streams 104*a* and 104*b* are representative of the subsidiary streams that would be introduced into such layers.

Turning first to layer 150, it is defined between side bars 154 and 156 and end bars 158 and 160 and parting sheet 162. The enclosure of layer 150 would be completed by the parting sheet of the next layer within main heat exchanger 3. Fins 164 are located within layer 150 to increase the heat transfer of subsidiary stream 104*a* and also to increase the structural integrity of layer 150. Subsidiary stream 104*a* enters layer 150 and is redirected into a first section of the layer 150 by a known network of distribution fins 168. The flow proceeds in an upward direction towards redistribution fins 170. It is to be noted that the design of the fins 164 on opposite sides of redistribution fins 170 could be of different configuration to obtain the most efficient heat transfer.

Figure 5:
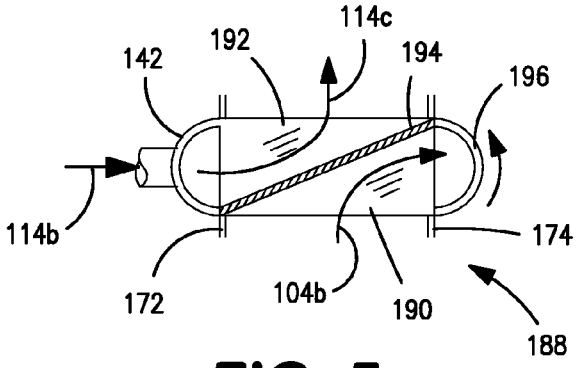
FIG. 5 is an enlarged, sectional view of a redistribution fin employed in the layer shown in FIG. 4.
Figure 6:
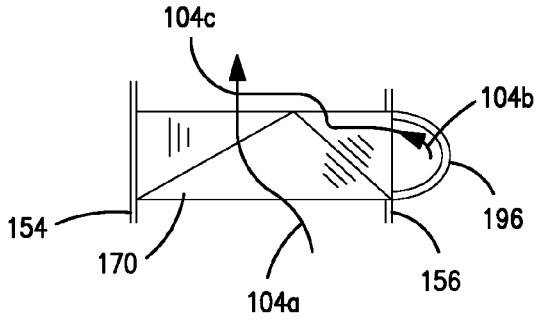
FIG. 6 is an enlarged, sectional view of a redistribution fin employed in the layer shown in FIG. 3.

Subsidiary stream 104*b* enters layer 152 that is defined between side bars 172 and 174 and end bars 176 and 178 and parting sheet 180. The enclosure of layer 152 would be completed by the parting sheet of the next layer within main heat exchanger 3. Fins 182 are located within layer 152 to increase the heat transfer of subsidiary stream 104*b* and for structural purposes. Subsidiary stream 104*b* enters layer 152 and is redirected into a first section of layer 152 by a known network of distribution fins 186. The flow proceeds in an upward direction towards redistribution fins 188. Again, it is to be noted that the design of fins 182 on opposite sides of redistribution fins 188 could be of different configuration to obtain the most efficient heat transfer. With reference to FIG. 5, redistribution fins 188 consist of redistribution fins 190 and 192 separated by a plate 194 for purposes that will be discussed in more detail hereinafter. The flow of subsidiary stream 104*b* is deflected by redistribution fins 190 towards redistribution header tank 196, also shown in FIG. 2, which is also in flow communication with the first section of layer(s) 150 and redistribution fins 170. As shown in FIG. 6, subsidiary stream 104*b* flows into redistribution header tank 196 and then into redistribution fins 170 of layer(s) 150 where it combines with subsidiary stream 104*a* to form combined subsidiary streams 104*c* that are directed into a second section of the layer(s) 150 and then to redistribution fins 198 of layer 150. The redistribution fins 198 direct the combined subsidiary streams 104*c* into header tank 140, also shown in FIG. 2, where the combined subsidiary streams 104*c* recombine into oxygen product stream 106 which is discharged from the heat exchanger 3.

Consequently, subsidiary streams 104*a* and 104*b* respectively warm within first sections of the layer(s) 150 defined between redistribution fins 168 and 170 and within the first sections of the layers 152 defined between redistribution fins 186 and 188 and then fully warm within the second sections of the layer(s) 150 that are defined between redistribution fins 170 and 198 or in other words the oxygen stream becomes superheated in such sections of layer(s) 150. Since a second section of layer(s) 152 defined between redistribution fins 188 and 202 is not used for the heat exchange involving subsidiary stream 104*b*, a region of such layer(s) exists for the heat exchange of refrigerant stream 114*b* that is introduced into header pipe 142 and then redistribution fins 192, at the other side of plate 194, to direct the flow within layer 152 and fins 182 to redistribution fins 202 where the now warmed subsidiary refrigerant stream(s) 114*c* are discharged into header pipe 144 to form recycle stream 114*a*. It is to be noted that it is possible for refrigerant stream 114*b* to be at an inlet temperature above the point at which oxygen is redistributed by redistribution fins 188. In such case separate redistribution fins would be employed to discharge subsidiary streams 104*b* to redistribution header 196 and for the inlet of refrigerant stream 114*b*. This in fact might be required if a mechanical chiller were used to supply the refrigerant to main heat exchanger 3. In any event, the total cross-section area of main heat exchanger 3 provided for the cold refrigeration stream 114*b* is preferably between about 5 percent and about 10 percent of the total available area.

The redistribution fins 188 of layer(s) 152, the redistribution fins 170 of layer(s) 150 and the redistribution header 196 are situated at a location of the main heat exchanger 3 at which the temperature of the subsidiary streams 104*a* and 104*b* exceeds the critical temperature, in case of a critical pressure, by about 3 Kelvin or the dew point temperature, in case of a pressure below the critical pressure, by about 5 Kelvin. Such locations can be found by simulations well known to those skilled in the art. It is to be noted that since the combined subsidiary streams 104*c* further warm within the second sections of the layer 150, such temperature is below the warm end temperature of the main heat exchanger 3 or in other words, the temperature at redistribution fins 198. It is to be noted that the reason for designing the layers in a manner that the critical or dew point temperature is exceeded before combining subsidiary streams 104*a* and 104*b* is to assure that sufficient heat exchange area exists to either create a supercritical fluid or completely vaporize the oxygen prior to further warming the combined subsidiary streams 104*c*. The degree to which such temperature is exceeded will of course decrease the remaining regions of the layers that can be utilized for warming or cooling another stream, for example, warming the cool refrigerant stream 114*b*. The preferred temperature, given above, for exceeding the critical or dew point temperature thus represents a safety factor in the design of main heat exchanger 3 given the fact that due to variations in the air feed due to temperature and pressure, the temperature of main heat exchanger 3 at redistribution fins 198 will also vary. As would also be known to those skilled in the art, since streams warm in both layers 150 and 152, such layers would be located adjacent to layers employed in cooling streams, which in cryogenic rectification plant 1 would be the layers used in cooling the first compressed stream 24.

In main heat exchanger 1, it is contemplated that the layers involved in cooling first compressed stream 24 extend the full height thereof. However as would be understood by those skilled in the art, it is possible to utilize the unused regions of the layers that are employed in partially cooling the second compressed stream 30 in the cooling of first compressed stream 24.

Figure 7:
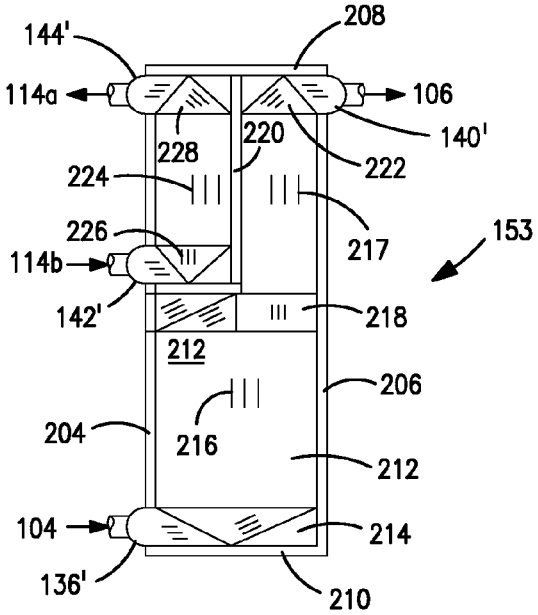
FIG. 7 is an alternative embodiment of a layer of a main heat exchanger used in the cryogenic rectification plant shown in FIG. 1 that serves to warm the pumped liquid oxygen and also, to warm or cool one other stream such as a refrigerant stream.
Figure 8:
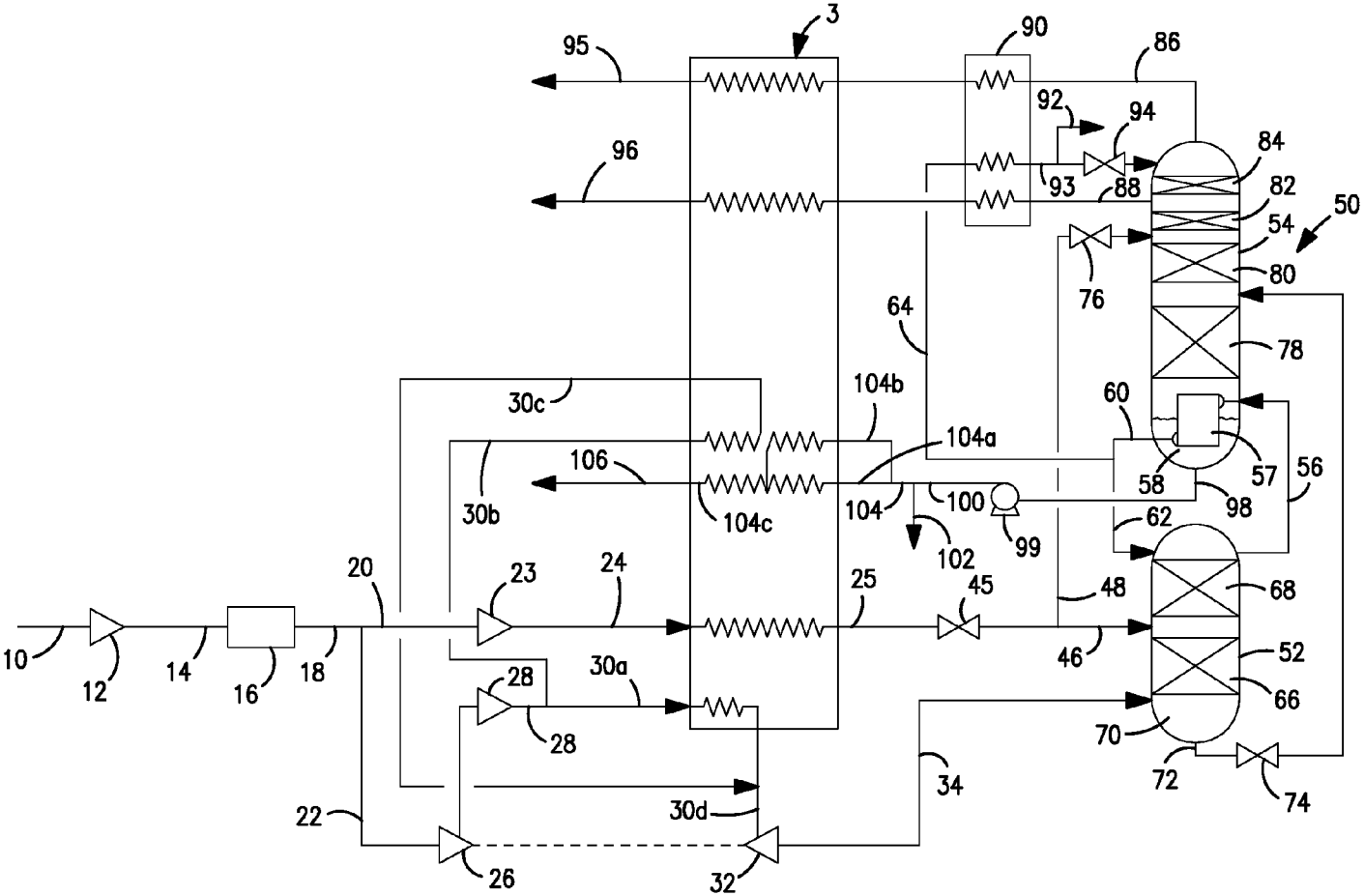
FIG. 8 is an alternative embodiment of the cryogenic rectification plant shown in FIG. 1 in which one other stream associated with the plant is cooled within the layer of the main heat exchanger that is also used in warming the pumped liquid oxygen stream.

Layers 150 and 152 are designed to reduce the heat transfer area provided for further warming the portion 104 of the pumped liquid oxygen stream 100 after a critical temperature or dew point temperature is reached to leave regions of such layers available for heating the cooled refrigerant stream 114*b*. As discussed above, this is done by combining subsidiary streams 104*a* and 104*b* and then only using the second sections of layers 150 for warming the combined subsidiary streams 104*c*. Another possibility is shown in FIG. 7 in which there is no division of the portion 104 of the pumped liquid oxygen stream 100 and hence no combination of subsidiary streams into combined subsidiary streams. In such embodiment, a layer 153 is shown that is defined between side bars 204 and 206 and end bars 208 and 210 and parting sheet 212. Part 104 of pumped liquid oxygen stream 100 is introduced into header tank 136' to produce subsidiary streams that are directed by redistribution fins 214 into a first section of layer 153 containing fins 216. The subsidiary streams then flow into a second section containing fins 217 by way of redistribution fins 218. Such second section is defined between the redistribution fins 218, a dividing bar 220 and another set of redistribution fins 222. The subsidiary streams then flow out of such second section by the provision of redistribution fins 222 and collect within header tank 140' to allow the oxygen product stream 106 to be discharged therefrom. The redistribution fins 218 would be positioned at a location at which the temperature of the subsidiary streams exceeded the critical temperature or dew point temperature as described above. The dividing bar thereby reduces the heat transfer area provided by layer 153 that is not required for the further heating of the stream 104 above the critical temperature or above the dew point temperature. Additionally, it defines another region or third section of layer 153 for the warming of the refrigerant stream 114*b*. Refrigerant stream 114*b* enters header tank 142' and subsidiary refrigerant streams thereof are directed to fins 224 by way of redistribution fins 226. Such subsidiary streams are then directed in such layers by way of redistribution fins 228 to header tank 144' for collection and discharge of recycle stream 114*b*.

As an alternative to the layer 153, a layer could be constructed in which rather than using a dividing bar, such as dividing bar 220, to divide the layer in a lengthwise direction, the depth of the layer could instead be divided into sub-layers by a plate. One sub-layer would form a region used to warm the refrigerant stream 114*b* or to cool or warm some other stream and another sub-layer would be used to superheat the oxygen in forming the oxygen product stream 106. The first sub-layer would be isolated from the second sub-layer by means of a half height dividing bar. The sub-layers would be individual fed with subsidiary streams of the portion 104 of the pumped liquid oxygen by a half-height redistribution fin and with a half-height distributor fin stacked on the oxygen redistribution fin to distribute the subsidiary refrigerant streams into a sublayer. Since the divided layer would constitute two warming layers adjacent to one another, it is important to ensure that there is a cooling stream on both sides of the split layer to avoid a situation where three cold layers are next to one another in the stacking pattern. Obviously if this happens the middle warming layer will only be able to transfer heat to a cooling layer through another warming layer, and this is inefficient, and introduces temperature gradients which may cause excessive thermal stress. Redistribution fins, stacked on one another would be provided to discharge such subsidiary streams from the layer to their respective header tanks.

Although the present invention has thus far been described as having application to the warming of refrigerant stream 114*b*, there are other possible applications of the present invention. For example, with reference to FIG. 7, an alternative embodiment of air separation plant 1 is illustrated that does not have the auxiliary refrigeration cycle. In such embodiment, the second compressed stream 30 can be divided into compressed streams 30*a* and 30*b*. Compressed stream 30*b* can be introduced into the same layers that would otherwise be used in connection with warming refrigerant stream 114*b* and cooled in such layers by being introduced into header pipe 144 and withdrawn from header pipe 142 after having been partially cooled. The resulting partially cooled compressed stream 30*c* would be combined with compressed stream 30*a* after having been partially warmed and the streams, as a combined stream 30*d* would be introduced into turboexpander 32. As would be apparent to those skilled in the art, the design of main heat exchanger 3 would have to be slightly modified in the ordering of the layers. Namely, layer 152 would have to be situated adjacent to at least one warming stream.

As would occur to those skilled in the art, the layers used in the present invention could also be used in the heating of nitrogen products that are desired at high pressure. In cryogenic rectification plants that are designed for such purposes, nitrogen-rich liquid streams can be pumped to the desired pressure, for example, stream 92 either alone or in addition to oxygen-rich liquid stream 98 that, as discussed above, is pumped and then vaporized in main heat exchanger 3. If both of such streams were desired at pressure, main heat exchanger 3 could be modified to include layers, such as described above, for both of such streams.

Although the present invention has been discussed with reference to preferred embodiments, as would occur to those skilled in the art that numerous changes and omissions can be made without departing from the spirit and scope of the present invention as set forth in the appended claims.

We claim:

1. A method of producing a pressurized product stream comprising:

rectifying a feed stream containing oxygen and nitrogen by a cryogenic rectification process utilizing a main heat exchanger of plate-fin construction and a distillation column system operatively associated with the main heat exchanger;

pumping a product stream withdrawn from the distillation column system and composed of oxygen-rich liquid or nitrogen-rich liquid to produce a pumped product stream;

warming at least part of the pumped product stream within layers of the main heat exchanger to produce the pressurized product stream and warming or cooling one other stream within said layers;

the layers providing a heat transfer area within the main heat exchanger for the warming of the at least part of the pumped product stream that decreases, at least in part, by provision of regions within layers for warming or cooling of the one other stream, the regions positioned within the layers such that the heat transfer area decreases at a location of the main heat exchanger at which a temperature is reached within the main heat exchanger that exceeds the critical or dew point temperature of the pumped product stream the layers of the main heat exchanger include a first set of layers and a second set of layers, each of the first set of layers and the second set of layers have first sections and second sections;

subsidiary streams composed of the at least part of the pumped product stream are introduced into the first sections of the first set of layers and the second set of layers;

the subsidiary streams, after having been warmed within the first sections, are combined and introduced into the second sections of the first set of layers as combined subsidiary streams;

the combined subsidiary streams are further warmed within the second sections of the first set of layers;

the pressurized product stream is made up of the combined subsidiary streams after having been further warmed in the second sections of the first set of layers;

the regions are formed by the second sections of the second set of layer.

2. The method of claim 1, wherein:

at least one liquid product is produced by the distillation column system; and the one other stream is a refrigerant stream that is warmed within the main heat exchanger to increase production of the at least one liquid product.

3. The method of claim 2, wherein:

the layers of the main heat exchanger include a first set of layers and a second set of layers, each of the first set of layers and the second set of layers have first sections and second sections;

subsidiary streams composed of the at least part of the pumped product stream are introduced into the first sections of the first set of layers and the second set of layers;

the subsidiary streams, after having been warmed within the first sections, are combined and introduced into the second sections of the first set of layers as combined subsidiary streams;

the combined subsidiary streams are further warmed within the second sections of the first set of layers;

the pressurized product stream is made up of the combined subsidiary streams after having been further warmed in the second sections of the first set of layers;

the regions are formed by the second sections of the second set of layers; and subsidiary refrigerant streams composed of the refrigerant stream are introduced into and warmed within the second sections of the second set of layers.

4. The method of claim 3, wherein the refrigeration stream is produced in a closed loop refrigeration cycle.

5. The method of claim 4, wherein the refrigeration cycle includes compressing the refrigerant stream after having been warmed in the main heat exchanger, further compressing the refrigerant stream and subsequently expanding the refrigerant stream in a turbine to form an exhaust stream that is introduced into the second section of the second set of the layers.

6. The method of claim 5, wherein: the product stream withdrawn from the distillation column system is composed of the oxygen-rich liquid; and the cryogenic rectification process includes:

compressing and purifying the feed stream to produce a compressed and purified feed stream;

dividing the compressed and purified feed stream into a first compressed stream and a second compressed stream;

further compressing the first compressed stream, fully cooling the first compressed stream in the main heat exchanger to form a liquid stream, expanding the liquid stream and introducing the liquid stream into at least one of a high pressure column and a low pressure column;

the low pressure column being operatively associated with the high pressure column such that nitrogen-rich vapor produced as high pressure column overhead in the high pressure column is condensed to form reflux for the high pressure column and the low pressure column against vaporizing an oxygen-rich liquid column bottoms of the low pressure column, thereby to form the oxygen-rich liquid from residual liquid within the low pressure column and oxygen-rich high pressure column bottoms liquid in the high pressure column that is further refined in the low pressure column;

further compressing the second compressed stream, partially cooling the second compressed stream within the main heat exchanger, expanding the second compressed stream after having been partially cooled in a turboexpander to form an exhaust stream and introducing the exhaust stream into the high pressure column;

passing a low pressure nitrogen-rich vapor column overhead stream and an impure nitrogen waste stream extracted from the low pressure column into the main heat exchanger to help cool the feed stream after the compression and purification thereof to the temperature suitable for its rectification; and forming the at least one liquid product from at least one of a remaining part of the pumped liquid oxygen stream or a nitrogen-rich liquid stream from a portion of the nitrogen-rich vapor that is condensed and not used as the reflux.

7. An apparatus for producing a pressurized product stream comprising:

a cryogenic rectification plant configured to rectify a feed stream containing oxygen and nitrogen;

the cryogenic rectification plant having a main heat exchanger of plate-fin construction, a distillation column system operatively associated with the main heat exchanger and a pump;

the pump in flow communication with the distillation column system such that an oxygen-rich liquid or a nitrogen-rich liquid formed within the distillation column system is pumped to produce a pumped product stream;

the main heat exchanger connected to the pump and configured such that at least part of the pumped product stream is warmed within layers of the main heat exchanger to produce the pressurized product stream and one other stream is warmed or cooled within said layers;

the layers configured such that a heat transfer area provided within the main heat exchanger for the warming of the at least part of the pumped product stream decreases at least in part, by provision of regions within at least part of the layers for warming or cooling of the one other stream, the regions positioned within the layers such that the heat transfer area decreases at a location within the main heat exchanger at which a temperature is reached that exceeds critical temperature or dew point temperature of the pumped product stream the layers comprise a first set of layers and a second set of layers each having first sections and second sections;

the layers are configured such that subsidiary streams, made up of the at least part of the pumped product stream, warm within the first sections and combine at connections between the first sections and form combined subsidiary streams;

the second sections of the first set of layers are in flow communication with the first sections such that the combined subsidiary streams further warm within the second sections and form the pressurized product stream; and the regions are the second sections of the second set of layers.

8. The apparatus of claim 7, wherein:

the cryogenic rectification plant is configured to produce at least one liquid product; and the one other stream is a refrigeration stream that warms within the main heat exchanger to increase production of the at least one liquid product.

9. The apparatus of claim 8, wherein:

the layers comprise a first set of layers and a second set of layers each having first sections and second sections;

the layers are configured such that subsidiary streams, made up of the at least part of the pumped product stream, warm within the first sections and combine at connections between the first sections and thereby form combined subsidiary streams;

the second sections of the first set of layers are in flow communication with the first sections such that the combined subsidiary streams further warm within the second sections of the first set of layers and form the pressurized product stream;

the regions are the second sections of the second set of layers; and subsidiary refrigeration streams composed of the refrigeration stream warm within the second sections of the second set of layers.

10. The apparatus of claim 9, wherein the cryogenic rectification plant also has a refrigeration system connected to the main heat exchanger and configured to produce the refrigeration stream and to circulate the refrigerant stream through the second sections of the second set of layers.

11. The apparatus of claim 9, wherein the refrigeration system is a closed loop refrigeration cycle.

12. The apparatus of claim 11, wherein the cryogenic rectification plant includes a main compressor to compress the feed stream and the refrigeration system contains a valve operable to be set in an open position and situated to receive part of the feed stream after compression and thereby form the refrigeration stream from the part of the feed stream to serve as make-up for the refrigeration stream.

13. The apparatus of claim 12, wherein the refrigeration system has a recirculation compressor connected to the main heat exchanger and in flow communication with the second sections of the first set of the layers such that the refrigerant stream after having been warmed in the main heat exchanger is compressed in the recirculation compressor, a booster compressor to further compress the refrigerant stream and a turbine connected between the booster compressor and the location of the main heat exchanger such that an exhaust stream flows from the turbine into the second sections of the first set of the layers.

14. The apparatus of claim 13, wherein: the product stream withdrawn from the distillation column system is composed of the oxygen-rich liquid; and the cryogenic rectification plant comprises:

the distillation column system including a low pressure column operatively associated with a high pressure column such that nitrogen-rich vapor produced as high pressure column overhead is condensed to form reflux for the high pressure column and the low pressure column against vaporizing an oxygen-rich liquid column bottoms of the low pressure column, thereby to form the oxygen-rich liquid from residual liquid within the low pressure column and oxygen-rich high pressure column bottoms liquid is further refined in the low pressure column;

a main compressor connected to a purification unit for compressing and purifying the feed stream to produce a compressed and purified feed stream;

a booster compressor in flow communication with the purification unit to further compress a first compressed stream formed from another part of the compressed and purified feed stream;

the main heat exchanger in flow communication with the booster compressor and also configured to form a liquid stream, an expansion device connected to the main heat exchanger to expand the liquid stream and at least one of the high pressure column and the low pressure column in flow communication with the expansion device to receive the liquid stream;

another booster loaded turbine unit connected to the main heat exchanger, in flow communication with the purification unit so that a second compressed stream formed from a yet further part of the compressed and purified feed stream is further compressed, partially cooled within the main heat exchanger and expanded in a turboexpander to form an exhaust stream and the turboexpander in flow communication with the high pressure column such that the exhaust stream is introduced into the high pressure column;

the main heat exchanger also in flow communication with the low pressure column and configured so that a low pressure column overhead stream and an impure nitrogen waste stream passes from the low pressure column into the main heat exchanger and flow between the cold end and the warm end thereof to help cool the feed stream after compression to the temperature suitable for its rectification; and at least one outlet for discharging the at least one liquid product from at least one of another part of the pumped liquid oxygen stream and a portion of a nitrogen-rich liquid stream produced in the distillation column system.

* * * * *